US005623331A

United States Patent [19]

Kaneko et al.

[11] Patent Number: 5,623,331

[45] Date of Patent: Apr. 22, 1997

[54] HIGH-SPEED ELECTROPHOTOGRAPHIC FIXING UNIT

[75] Inventors: Tadahiro Kaneko; Takao Umeda; Tsutomu Maekawa; Teruaki Mitsuya, all of Ibaraki, Japan

[73] Assignees: Hitachi Koki Co., Ltd.; Hitachi Ltd., both of Tokyo, Japan

[21] Appl. No.: 451,565

[22] Filed: May 26, 1995

[30] Foreign Application Priority Data

May 27, 1994 [JP] Japan ..... 6-114936

[51] Int. Cl.[6] ..... G03G 15/20

[52] U.S. Cl. ..... 399/378

[58] Field of Search ..... 355/282, 285, 355/289, 290, 295, 308, 309

[56] References Cited

U.S. PATENT DOCUMENTS

| | | | |
|---|---|---|---|
| 4,163,892 | 8/1979 | Komatsu et al. . | |
| 4,937,631 | 6/1990 | Kim et al. | 355/290 |
| 5,087,947 | 2/1992 | Torino | 355/290 |
| 5,157,447 | 10/1992 | Farnand et al. | 355/290 |
| 5,187,527 | 2/1993 | Forlani et al. | 355/282 |
| 5,245,393 | 9/1993 | Storlie et al. | 355/290 |
| 5,255,060 | 10/1993 | Chikano | 355/290 |
| 5,386,280 | 1/1995 | Nishikawa | 355/282 |
| 5,436,712 | 7/1995 | Wayman et al. | 355/290 |

FOREIGN PATENT DOCUMENTS

| | | | |
|---|---|---|---|
| 53-39235 | 9/1978 | Japan | G03G 15/20 |
| 5-63795 | 9/1993 | Japan | G03G 15/20 |

OTHER PUBLICATIONS

Research Disclosure, Jun. 1988, 29011.

*IBM J. Res. Develop.*, vol. 22, No. 1, Jan. 1978, pp. 26–33.

*Primary Examiner*—Sandra L. Brase

*Attorney, Agent, or Firm*—Sughrue, Mion, Zinn, Macpeak & Seas

[57] ABSTRACT

A fixing unit includes a fixing roller, a pressure roller forming a nipper in cooperation with said fixing roller, the nipper conveying a recording material on which an unfixed image is formed while nipping the recording material, a recording material pressing roller disposed at least one of upstream and downstream of said nipper in a recording material conveyance direction for pressing said recording material toward the fixing roller to form a region where the recording material is wound around the fixing roller, and a tension applying unit for applying tension to the recording material.

7 Claims, 3 Drawing Sheets

HIGH-SPEED ELECTROPHOTOGRAPHIC FIXING UNIT

BACKGROUND OF THE INVENTION

1. Field of the Invention

The present invention relates to a fixing unit used for an electrophotographic apparatus or the like.

2. Description of the Related Art

As one type of fixing unit for use in a recording apparatus using a known electrophotographic process, there is known a so-called heat fixing system, which includes a fixing roller and a pressure roller forming a nipper in cooperation with the fixing roller, in which a recording material carrying an unfixed image is conveyed while being nipped by the nipper, and the image is then fixed onto the recording material.

As means for realizing high-speed fixing by using the fixing unit of the heat fixing system, there are known, for example, the following systems. One system is that a recording material is conveyed wound around a fixing roller, and the recording material is heated in a region where no nipper exists, as disclosed in Japanese Utility Model Examined Publication No. Sho 53-39235. Another system is that a plurality of pressure rollers are provided so that a recording material is heated by a plurality of nippers, as disclosed in Japanese Patent Examined Publication No. Hei 5-63795.

As described above, a variety of high-speed fixing units have been proposed. The structure of the foregoing fixing units may suffer from the problem that the recording material is out of close contact with the fixing roller in a region between two pressure rollers, causing a slack in the recording material. The slack results from the extension of the recording material due to heating by the fixing roller, or results from a difference in speed between the fixing roller and the recording material at the outlet of the nipper where the recording material is nipped.

At the stage where the recording material has passed a first pressure roller where the recording material is initially nipped, the image is insufficiently fixed onto the recording material. Therefore, toners on the recording material are transferred (offset) onto the fixing roller. If slack occurs in the recording material, when the recording material passes a second pressure roller where the recording material is subsequently nipped, the toners transferred (offset) onto the fixing roller return to the recording material. However, because a distance of travel of the original image on the slack recording material is longer than that of travel of the offset toner on a surface of the fixing roller, the offset toner is retransferred onto the recording material before the original image passes the nipping portion of the second pressure roller. That is, the position of the recording material onto which the offset toner is retransferred is forward of the position of the original image on the recording material in a conveyance direction of the recording material. This blurs the image on the recording material. Once a slack occurs in the recording material, because the recording material is nipped between two pressure rollers, the slack is not eliminated until the operation of fixing the recording material by the first or second pressure roller is suspended or terminated.

In the foregoing conventional fixing units, attention is insufficiently given to the flapping or slack of the recording material, which is caused when the recording material is conveyed, resulting in problems such that an image is blurred or image quality is low in strength of fixation.

SUMMARY OF THE INVENTION

The present invention has been made in view of the foregoing problems, and an object of the invention is to provide a fixing unit suitable for high-speed fixing operation.

The foregoing object of the invention has been achieved by the provision of a fixing unit having a fixing roller and a pressure roller which forms a nipper in cooperation with the fixing roller in which a recording material carrying an unfixed image is conveyed while being nipped by the nipper and then the image is fixed onto the recording material, the fixing unit comprising: a recording material pressing roller for pressing the recording material against the fixing roller side at least one of upstream and downstream of the nipper in a direction in which the recording material is conveyed to form a region where the recording material is wound around the fixing roller; and tension applying means for applying tension to the recording material.

The contact of the recording material with the fixing roller at a portion outside of the nipping portion causes a large amount of thermal energy to be supplied to the recording material. The support of the recording material due to the recording material pressing roller can enhance adhesion between toners and the recording material, that is, it has the effect of remarkably enhancing the strength of fixation. The location of the recording material pressing roller can eliminate the fluctuation of a length of a contact portion of recording material for the purpose of fixing a start or end position of the contact of the fixing roller with the recording material to a contact position of the recording material pressing roller with the recording material. The application of tension from the outside of the recording material pressing roller to the recording material can prevent slack in the recording material at the contact portion.

The above and other objects and features of the present invention will be more apparent from the following description taken in conjunction with the accompanying drawings.

DETAILED DESCRIPTION OF THE PREFERRED EMBODIMENTS

Now, a description will be given of fixing units in accordance with the embodiments of the present invention with reference to the accompanying drawings.

First Embodiment

Hereinafter, a first embodiment of the invention will be described with reference to FIG. 1.

Figure 1:
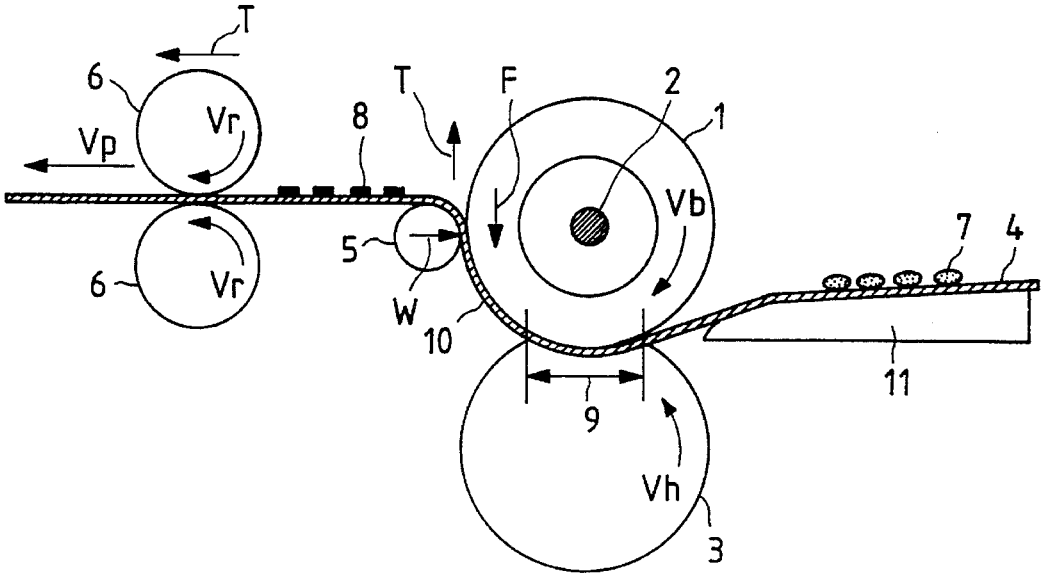
FIG. 1 is a sectional side view showing a fixing unit according to a first embodiment of the present invention.

FIG. 1 is a sectional side view showing a fixing unit in accordance with the first embodiment of the invention. Reference numeral 1 denotes a fixing roller; 2, a heater; 3, a pressure roller; 4, a recording material; 5, a recording material pressing roller; 6, tension applying means (tension applying rollers); 7, unfixed toners; 8, fixed toners; 9, a nipper; 10, a backward contact portion; T, tension applied to the recording material 4 due to the tension applying rollers 6; F, a frictional force exerted between the recording material 4 and the fixing roller 1 at a position corresponding to the recording material pressing roller 5; and W, a pressing force which is applied to the recording material pressing roller.

Figure 2:
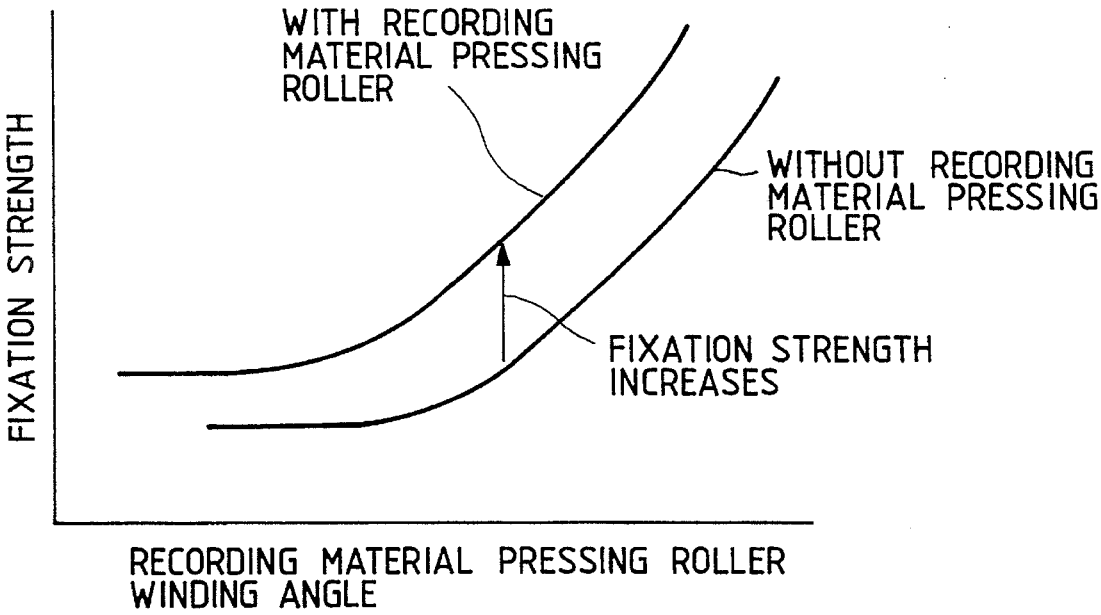
FIG. 2 is a graph representing the relationship between a winding angle of a recording material pressing roller and a fixing strength.

The nipper 9 is formed by bringing the pressure roller 3 in pressure contact with the fixing roller 1 which has been heated by the heater 2 consisting of a halogen lamp. The recording material 4 is a continuous folding paper (fan fold paper), on which a toner image is formed. The recording material 4 receives tension in the same direction as that of conveyance of the recording material 4 by the action of the tension applying rollers 6. The recording material 4 reaches the recording material pressing roller 5 through the backward contact portion 10 after it has passed the nipper 9 which is formed by the fixing roller 1 and the pressure roller 3. During this process, the unfixed toners 7 are heated and pressed by the nipper 9, satisfactorily heated together with the recording material 4 at the backward contact portion 10, and further receive thermal energy sufficient to melt toners between the fixing roller 1 and the recording material pressing roller 5. This is represented as the fixed toners 8 in FIG. 1. The recording material pressing roller 5 is in contact with a reverse side of a surface of the recording material on which an image is formed, and is driven depending on the travel of the recording material 4. The recording material pressing roller 5 is an elastic roller consisting of silicon rubber and fluororesin formed on the surface of the silicon rubber. In the figure, the recording material pressing roller 5 appears to nip the recording material 4 strongly in cooperation with the fixing roller 1. However, in fact, its pressing force is low, so that the tension applied by the tension applying rollers 6 reaches the backward contact portion 10. Therefore, since tension is applied to the recording material 4 even at the backward contact portion 10, no slack of the recording material 4 occurs at the backward contact portion 10. Also, the recording material 4 is supported by the recording material pressing roller 5 at the end position of the backward contact portion of the fixing roller 1. This causes toners sufficiently melted at the backward contact portion 10 to be readily deformed, thereby enhancing adhesion between toners and the recording material 4. Thus, the strength of fixation is increased. This effect is represented by FIG. 2. In this example, the effect shown in FIG. 2 cannot be obtained by using only the backward contact portion 10.

Now, a description will be given of the relationship between a tension T and a pressing force W. In this explanation, E is a yield strength of the recording material 4, and $\mu_0$ is a static frictional coefficient between the recording material 4 and the fixing roller 1. In this example, yield strength E is defined as a minimum strength given by the product of the yield stress of the recording material 4 and an area given by the distance of the recording material 4 to which tension T is applied in a direction perpendicular to the conveyance direction and the width of the recording material 4. For example, the yield strength of a portion of the recording material 4 is low where perforations or holes for conveyance are formed. Therefore, the minimum force is defined as a yield strength of the recording material 4.

The necessary conditions for providing the effect of the fixing unit of the present invention are described as follows. In order to permit tension T, given to the recording material 4 by the tension applying rollers 6, to act on the recording material at the backward contact portion 10 of the fixing roller 1, the following inequality must be satisfied.

$$T>F \tag{1}$$

where $$F=\mu_0 W \tag{2}$$

In order to ensure the recording material 4 is not deformed by tension T, the following inequality must be satisfied.

$$E>T \tag{3}$$

The above expressions are represented by the following one inequality.

$$E>T>\mu_0 W \tag{4}$$

In other words, tension T given to the recording material 4 by the tension applying rollers 6 and pressing force W of the pressing roller 5 are determined so that a tension higher than static frictional force F can act on the recording material 4 in a range not exceeding the yield force E of the recording material 4. Therefore, it is possible to surely apply tension to the recording material 4 at the backward contact portion 10 without causing the deformation of the recording material 4.

According to the foregoing first embodiment of the present invention, whatever the thickness of the recording material 4 may be, high fixing strength can be maintained by supporting the recording material 4 by the recording material pressing roller 5. Also, because tension acts on the recording material 4 even at the backward contact portion 10, no slack occurs. Accordingly, there can be provided a downsized fixing unit which eliminates unstable fixation quality and image blurring even when printing is executed at high speed.

Second Embodiment

Hereinafter, a second embodiment of the invention will be described with reference to FIG. 3.

Figure 3:
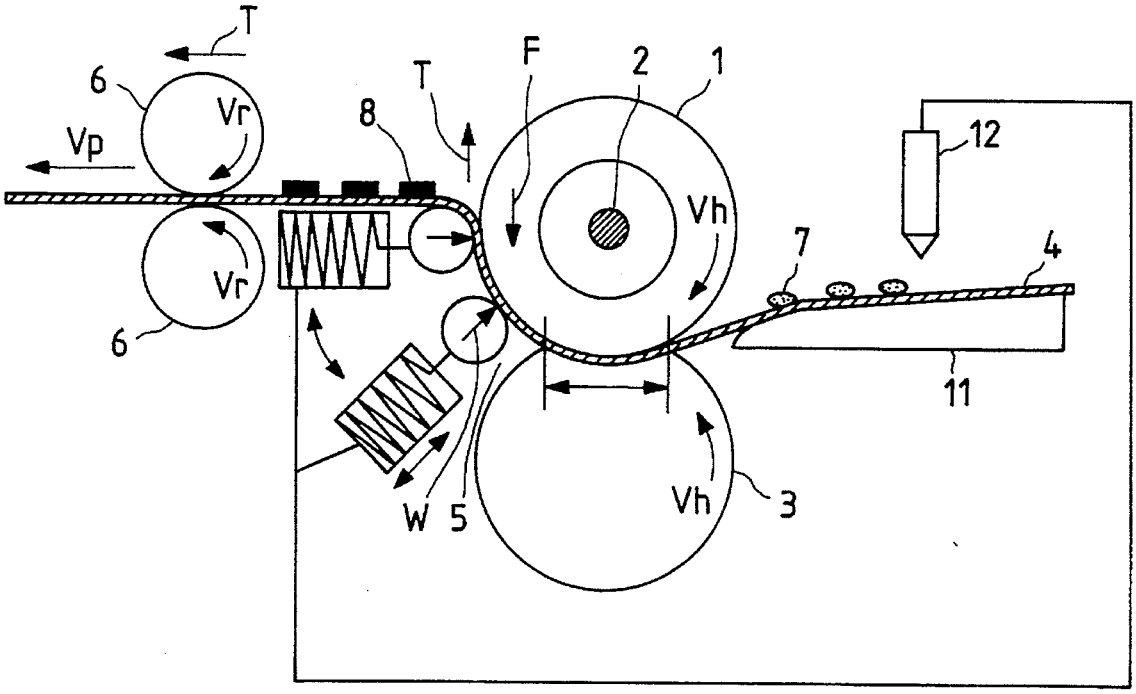
FIG. 3 is a sectional side view showing a fixing unit according to a second embodiment of the present invention.

FIG. 3 is a sectional side view showing a fixing unit in accordance with the second embodiment of the invention. Reference numeral 12 denotes a thickness detector for the recording material 4. This embodiment is identical in reference numerals and in the structure of the fixing unit to the first embodiment except that the thickness detector 12 produces a signal representative of the thickness of the recording material 4 to set a position at which the recording material pressing roller 5 is fixed and the pressing force W for controlling the operation of the fixing unit.

In this embodiment, as a result of detection of the thickness of the recording material 4 by the thickness detector 12, if the thickness of the recording material 4 is thin, the pressing force W of the recording material pressing roller 5 is set low since the recording material 4 and the unfixed toners 7 are readily heated. Therefore, the position of the recording material pressing roller 5 can be set so that a contact region of the fixing roller 1 and the recording material 4 is reduced. If the thickness of the recording material 4 is thick, this makes it difficult to heat the recording material 4 and the unfixed toners 7. Therefore, the pressing force W of the recording material pressing roller 5 is set high, and the position of the recording material pressing roller 5 is set so that the contact region of the fixing roller 1 and the recording material 4 is increased. In this manner, the pressing force W and position of the recording material pressing roller 5 are set on the basis of the detected thickness of a recording material 4, thereby obtaining the strength of fixation which is stable regardless of the thickness of the recording material 4. Hence, before entering the nipper, the fixing unit is controlled in such a manner that the recording material 4 passes the thickness detector 12 which detects the thickness of the recording material 4 on the basis of the transmissivity of light, and a sensor provided in the detector 12 converts the detected thickness of the recording material into an electric signal so that the position of the recording material pressing roller 5 and the end position of the backward contact portion 10 are set on the basis of that electric signal. According to this embodiment, high and stable strength and quality of fixation can be obtained regardless of the thickness of the recording material 4.

Third Embodiment

Figure 4:
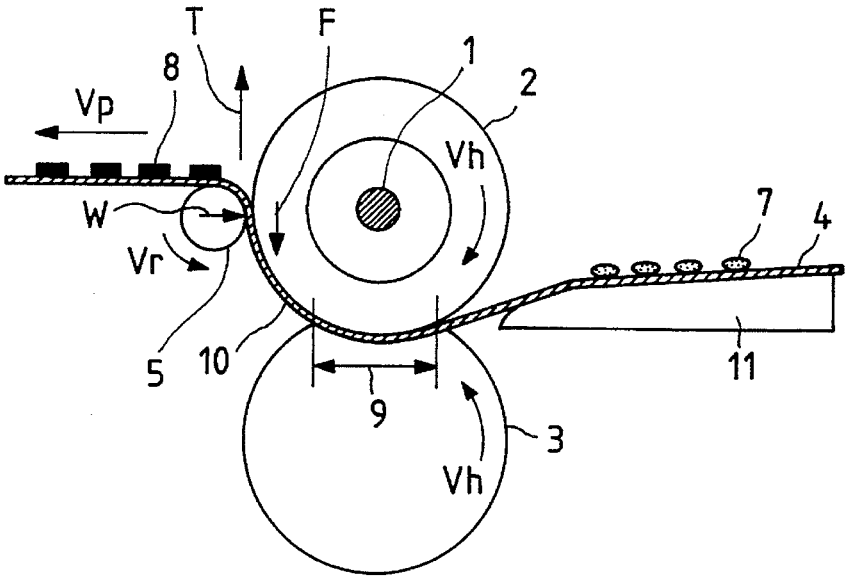
FIG. 4 is a sectional side view showing a fixing unit according to a third embodiment of the present invention.

A description will be given of a third embodiment of the present invention with reference to FIG. 4.

The recording material pressing roller 5 may be constituted so as to provide the functions of the tension applying means and the recording material pressing roller together. In other words, in this embodiment, tension T applied to the recording material 4 is given by the recording material pressing roller 5. Hence, the recording material pressing roller 5 is not a roller driven by the recording material 4 but a drive roller which drives itself. In other words, the surface speed of the recording material pressing roller 5 is higher than the conveyance speed of the recording material 4 with the result that a slippage is caused between the surfaces of the recording material 4 and the recording material pressing roller 5 all the time. If $V_h$ is a surface speed of the fixing roller 1, $V_p$ is a conveyance speed of the recording material 4, and $V_r$ is a surface speed of the recording material pressing roller 5, then the following inequality is satisfied.

$$V_h=V_p<V_r \tag{5}$$

When the coefficient of dynamic friction between the surfaces of the recording material 4 and the recording material pressing roller 5 is $\mu_1$, tension T given to the recording material 4 by the recording material pressing roller 5 is expressed by the following expression.

$$T=\mu_1 W \tag{6}$$

When Expression 5 is substituted in Expression 4, the necessary condition to obtain the effect of the fixing unit of the present invention is provided as follows.

$$E>\mu_1 W>\mu_0 W \tag{7}$$

Specifically, the material of the surface layer of the recording material pressing roller 5 is determined so that the following inequalities can be satisfied.

$$V_p<V_r$$

$$\mu_1>\mu_0$$

Further, pressing force W of the recording material pressing roller 5 is determined so that a tension higher than static frictional force acting on the recording material 4 between the fixing roller 1 and the recording material pressing roller 5 can be applied to the recording material 4 in a range not exceeding yield strength E of the recording material 4. In the case where fluororesin is used for the surface layer of the fixing roller 1, silicon rubber or the like is used for the material of the surface layer of the recording material pressing roller 5.

According to the foregoing third embodiment, even when the tension applying rollers 6 are omitted, the same force relationship as that of the first embodiment can be provided. Therefore, whatever the thickness of the recording material 4 may be, when the recording material 4 is supported by the recording material pressing roller 5, a backward contact length of the recording material 4 and the fixing roller 1 can be held constant. Further, the occurrence of slack can be prevented by applying tension to the recording material 4 at the backward contact portion 10. As a result, there is provided a downsized fixing unit which eliminates unstable quality of fixation and image blurring even when printing is executed at high speed. Furthermore, since no exclusive tension applying device for the recording material is required, there is provided a fixing unit which can be further downsized.

Although the explicit description is not made, there can be provided a downsized fixing unit which provides high strength of fixation and eliminates unstable quality of fixation and image blurring even when tension is provided by the recording material pressing roller 5 and tension applying rollers 6 as in the first embodiment. In this example, if it is assumed that $T_s$ is a total tension given by the recording material pressing roller 5 and tension applying rollers 6, the necessary condition to obtain the effect of the fixing unit of the present invention is described as follows.

$$E>\mu_1 W+T_s>\mu_0 W \tag{8}$$

Fourth Embodiment

A description will be given of fourth and fifth embodiments of the present invention with reference to FIGS. 5 and 6. The foregoing first to third embodiments are examples in which a contact portion is provided downstream of the melting and nipping portion. However the same problems arise where a contact portion is provided upstream of the melting and nipping portion.

Figure 5:
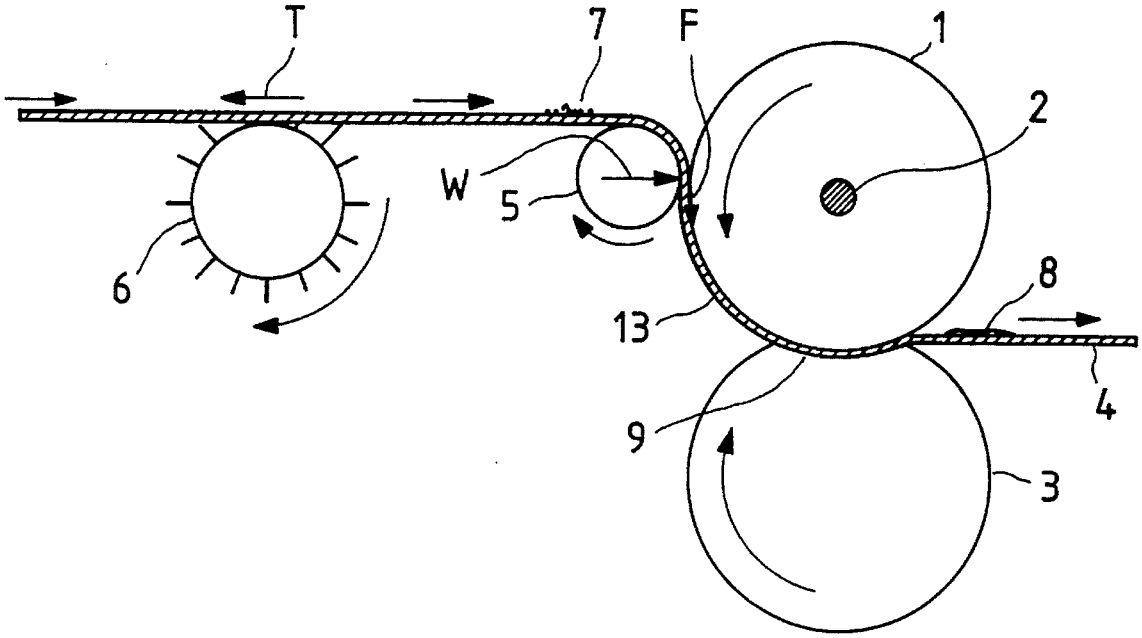
FIG. 5 is a sectional side view showing a fixing unit according to a fourth embodiment of the present invention.

FIG. 5 is a sectional side view showing a fixing unit in accordance with a fourth embodiment of the present invention. Reference numeral 1 denotes a fixing roller; 2, a heater; 3, a pressure roller; 4, a recording material; 5, a recording material pressing roller; 6, a tension applying roller; 7, unfixed toners; 8, fixed toners; 9, a melting and nipping portion; 13, a forward contact portion; T, tension given to the recording material 4 by the tension applying roller 6; F, a frictional force acting between the recording material 4 and the fixing roller 1 at a position corresponding to the recording material pressing roller 5; and W, pressing force applied to the recording material pressing roller 5.

The melting and nipping portion 9 is formed by bringing the pressure roller 3 in pressure contact with the fixing roller 1 which has been heated by the heater 2 consisting of a halogen lamp. The recording material 4 is a continuous folding paper (fan fold paper), on which a toner image is formed. The recording material 4 receives tension in a direction opposite to that of conveyance of the recording material 4 by the action of the tension applying roller 6. In this situation, since the unfixed toners 7 are deposited on the upper surface of recording material 4, a pair of rollers forming a nipping portion cannot be used for the application of tension. Therefore, the tension applying roller 6 is so arranged as to apply tension to the recording material 4 by using small holes for conveyance existing at regular intervals at both ends of the recording material 4 in a direction perpendicular to the conveyance direction of the continuous folding paper. After being inserted between the fixing roller 1 and the recording material pressing roller 5, the recording material 4 reaches the melting and nipping portion 9, which is formed by the fixing roller 1 and the pressure roller 2, through the forward contact portion 13. During this process, the unfixed toners 7 are preheated together with the recording material 4 at the forward contact portion 13, and are then heated and pressed at the melting and nipping portion 9. As a result, energy is satisfactorily applied to the unfixed toners 7 which have passed the melting and nipping portion 9, so that the unfixed toners are fixed onto the recording material 4. This is represented by the fixed toners 8. The recording material pressing roller 5 is in contact with the reverse side of the image formation surface of the recording material 4, and driven depending on the travel of the recording material 4. The recording material pressing roller 5 is an elastic roller consisting of a silicon rubber and fluororesin formed on the surface of the silicon rubber. In the figure, the recording material pressing roller 5 appears to nip the recording material 4 strongly in cooperation with the fixing roller 1. However, in fact, its pressing force is low, so that the tension of the tension applying rollers 6 reaches the forward contact portion 13. Therefore, since the tension is applied to the recording material 4 even at the forward contact portion 13, no slack of the recording material 4 occurs at the forward contact portion 13. Also, the recording material 4 is supported by the recording material pressing roller 5 at the start position of the forward contact portion of the fixing roller 1. As a result, the flattening of the recording material 4, which occurs upstream of the recording material pressing roller 5, exerts no influence on the recording material 4 at the forward contact start position and the forward contact portion 13 downstream thereof. Therefore, whatever the thickness of the recording material 4 may be, a fixing process can be continued while holding the contact length of the recording material 4 and the fixing roller 1 constant.

Now, the description will be given of a relationship between a tension T and a pressing force W. In this explanation, E is a yield strength of the recording material 4, and $\mu_0$ is a static frictional coefficient between the recording material 4 and the fixing roller 1. In this example, yield strength E is defined as a minimum strength given by the product of the yield stress of the recording material 4 and the width of the recording material 4 in a direction perpendicular to the conveyance direction.

The necessary conditions for providing the effect of the fixing unit of the present invention are described as follows. In order to permit tension T given to the recording material 4 by the tension applying roller 6 to act on the recording material 4 at the forward contact portion 13, the following inequality must be satisfied.

$$T>F \tag{9}$$

where $$F=\mu_0 W \tag{10}$$

In order to ensure the recording material 4 is not deformed by tension T, the following inequality must be satisfied.

$$E>T \tag{11}$$

The above expressions are represented by the following one inequality.

$$E>T>\mu_0 W \tag{12}$$

In other words, it is possible to determine tension T given to the recording material 4 by the tension applying rollers 6 and pressing force W of the recording material pressing roller 5 so that a tension higher than static frictional force F can act on the recording material 4 in a range not exceeding the yield strength E of the recording material 4. Therefore, it is possible to apply tension to the recording material 4 at the forward contact portion 13 without causing the deformation of the recording material 4.

According to the foregoing fourth embodiment of the present invention, whatever the thickness of the recording material 4 may be, the forward contact length of the recording material 4 and the fixing roller 1 can be held constant, and tension acts on the recording material 4 even at the forward contact portion 13, whereby no slack occurs in the recording material 4. As a result, there can be provided a downsized fixing unit which is high in strength of fixation and eliminates unstable quality of fixation and image blurring even when printing is executed at high speed.

Fifth Embodiment

Hereinafter, a description will be given of a sixth embodiment of the present invention with reference to FIG. 6.

Figure 6:
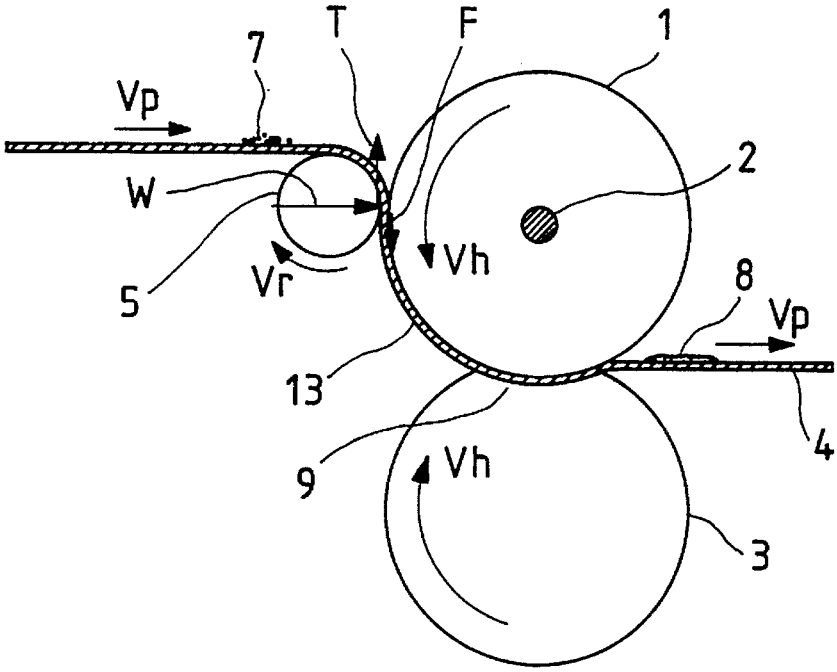
FIG. 6 is a sectional side view showing a fixing unit according to a fifth embodiment of the present invention.

FIG. 6 is a sectional side view showing a fixing unit in accordance with the fifth embodiment of the present invention. This embodiment is identical in reference symbols and the structure of a fixing unit according to the fourth embodiment except that no tension applying roller 6 exists.

In this embodiment, tension T is applied to the recording material 4 by the recording material pressing roller 5. Therefore, the recording material pressing roller 5 is not a roller driven by the recording material 4 but a drive roller which drives itself. The surface speed of the recording material pressing roller 5 is lower than the conveyance speed of the recording material 4 with the result that a slippage is caused between the surfaces of the recording material 4 and the recording material pressing roller 5 all the time. If $V_h$ is a surface speed of the fixing roller 1, $V_p$ is a conveyance speed of the recording material 4, and $V_r$ is a surface speed of the recording material pressing roller 5, then the following inequality is satisfied.

$$V_h=V_p>V_r \tag{13}$$

When the coefficient of dynamic friction between the surfaces of the recording material 4 and the recording material pressing roller 5 is $\mu_1$, tension T given to the recording material 4 by the recording material pressing roller 5 is expressed by the following expression.

$$T=\mu_1 W \tag{14}$$

When Expression 14 is substituted in Expression 12, the necessary condition to obtain the effect of the fixing unit of the present invention is provided as follows.

$$E>\mu_1 W>\mu_0 W \tag{15}$$

Specifically, the material of the surface layer of the recording material pressing roller 5 is determined so that the following inequalities can be satisfied.

$$V_p>V_r$$

$$\mu_1>\mu_0$$

Further, pressing force W of the recording material pressing roller 5 is determined so that a tension higher than static frictional force acts on the recording material 4 in a range not exceeding yield strength E of the recording material 4. In the case where fluororesin is used for the surface layer of the fixing roller 1, silicon rubber or the like is used for the material of the surface layer of the recording material pressing roller 5.

According to the foregoing fifth embodiment, even when the tension applying rollers 6 are omitted, the same force relationship as that of the fourth embodiment can be provided. Therefore, whatever the thickness of the recording material 4 may be, when the recording material 4 is supported by the recording material pressing roller 5, a forward contact length of the recording material 4 and the fixing roller 1 can be held constant. Further, the occurrence of slack can be prevented by applying tension to the recording material 4 at the forward contact portion 13. As a result, there can be provided a downsized fixing unit which is high in strength of fixation and eliminates unstable quality of fixation and image blurring even when printing is executed at high speed. In this example, if it is assumed that $T_s$ is a tension given by the tension applying rollers 6, the necessary condition to obtain the effect of the fixing unit of the present invention is described as follows.

$$E>\mu_1 W+T_s>\mu_0 W$$

In the foregoing embodiments, in order to enhance the effects of the invention, the following conditions are satisfied:

$$r_1 \geqq r_2, \text{ and } r_1>r_3$$

where $r_1$ is a radius of said fixing roller, $r_2$ is a radius of said pressure roller and $r_3$ is a radius of said recording material pressing roller, As was described above, according to the present invention, since the recording material is brought in even contact with the fixing roller in a region except for the nipping portion, the recording material can be satisfactorily heated. Also, since the recording material pressing roller is located at a position corresponding to the contact start or end position of the recording material, the length of the contact portion is prevented from fluctuating. Further, since tension is applied to the recording material at the contact portion, slack in the recording material can be prevented. As a result, a fixing unit can be provided which eliminates unstable fixation quality and image blurring even when the fixing operation provides a executed at high speed, and is high strength of fixation.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing unit, comprising:

a fixing roller;

a pressure roller forming a nipper in cooperation with said fixing roller, said nipper conveying a recording material on which an unfixed image is formed while nipping said recording material;

a recording material pressing roller for pressing said recording material toward said fixing roller in a region, except for a nipping region where said nipper nips said recording material, to form a region where said recording material is wound around said fixing roller; and tension applying means for applying tension to said recording material while said recording material is being nipped, wherein said recording material pressing roller has a winding angle of said recording material to said fixing roller and a pressing force of pressing said recording material toward said fixing roller, said winding angle and said pressing force being changeable according to a thickness of said recording material.

2. A fixing unit as claimed in claim 1, wherein said tension applying means applies tension higher than a frictional force acting between said fixing roller and said recording material to said recording material.

3. A fixing unit as claimed in claim 1, wherein tension force applied to said recording material by said tension applying means is lower than a minimum yield strength of said recording material.

4. A fixing unit as claimed in claim 1, wherein, if $r_1$ is a radius of said fixing roller, $r_2$ is a radius of said pressure roller and $r_3$ is a radius of said recording material pressing roller, the following conditions are satisfied:

$$r_1 \geqq r_2, \text{ and } r_1>r_3.$$

5. A fixing unit, comprising:

a fixing roller;

a pressure roller forming a nipper in cooperation with said fixing roller, said nipper conveying a recording material on which an unfixed image is formed while nipping said recording material;

a recording material pressing roller for pressing said recording material toward said fixing roller downstream of said nipper in a direction along which said recording material is conveyed to form a region where said recording material is wound around said fixing roller; and tension applying means for applying tension to said recording material while said recording material is being nipped, wherein said recording material pressing roller has a winding angle of said recording material to said fixing roller and a pressing force of pressing said recording material toward said fixing roller, said winding angle and said pressing force being changeable according to a thickness of said recording material.

6. A fixing unit, comprising:

a fixing roller;

a pressure roller forming a nipper in cooperation with said fixing roller, said nipper conveying a recording material on which an unfixed image is formed while nipping said recording material;

a recording material pressing roller for pressing said recording material toward said fixing roller upstream of said nipper in a direction along which said recording material is conveyed to form a region where said recording material is wound around said fixing roller; and tension applying means for applying tension to said recording material while said recording material is being nipped, wherein said recording material pressing roller has a winding angle of said recording material to said fixing roller and a pressing force of pressing said recording material toward said fixing roller, said winding angle and said pressing force being changeable according to a thickness of said recording material.

7. A fixing unit as claimed in claim 6, wherein said tension applying means is disposed upstream of said recording material pressing roller in the direction along which said recording material is conveyed.

* * * * *